US011071343B2

(12) United States Patent
Trinidad

(10) Patent No.: US 11,071,343 B2
(45) Date of Patent: Jul. 27, 2021

(54) CAP WITH INTERCHANGEABLE ART

(71) Applicant: CAPPS LLC, Manati, PR (US)

(72) Inventor: Adil Trinidad, Manati, PR (US)

( * ) Notice: Subject to any disclaimer, the term of this patent is extended or adjusted under 35 U.S.C. 154(b) by 0 days.

(21) Appl. No.: 16/057,259

(22) Filed: Aug. 7, 2018

(65) Prior Publication Data

US 2019/0037947 A1 Feb. 7, 2019

Related U.S. Application Data

(60) Provisional application No. 62/542,129, filed on Aug. 7, 2017.

(51) Int. Cl.

| | |
|---|---|
| ***A42B 1/22*** | (2006.01) |
| ***A42B 1/004*** | (2021.01) |
| ***A42B 1/205*** | (2021.01) |
| ***A42B 1/248*** | (2021.01) |

(52) U.S. Cl.

CPC ..... *A42B 1/004* (2013.01); *A42B 1/205* (2013.01); *A42B 1/248* (2013.01); *A42B 1/22* (2013.01)

(58) Field of Classification Search

CPC ..... A42B 1/004; A42B 1/205; A42B 1/22; A42B 1/248

See application file for complete search history.

(56) References Cited

U.S. PATENT DOCUMENTS 4,611,355 A * 9/1986 Galanto ..... A42B 1/248 2/209.13
4,776,043 A * 10/1988 Coleman ..... A42B 1/248 2/195.1
4,901,211 A * 2/1990 Shen ..... A42B 1/248 2/12
4,918,758 A * 4/1990 Rendina ..... A63F 9/0098 2/171
5,003,640 A * 4/1991 Pizzacar ..... A42B 1/248 2/181.4
5,253,368 A * 10/1993 Blake ..... A42B 1/248 2/195.1
5,359,733 A * 11/1994 Brannon ..... A42B 1/248 2/195.1
5,452,479 A * 9/1995 Mostert ..... A42B 1/248 2/195.1
5,465,426 A * 11/1995 Beaton ..... A42B 1/248 2/181
5,509,144 A * 4/1996 Soergel ..... A42B 1/248 2/195.1
5,548,847 A * 8/1996 Spicijaric ..... A42B 1/248 2/181
5,740,557 A * 4/1998 Reid ..... A42B 1/248 2/195.1

(Continued)

*Primary Examiner* — Richale L Quinn

(74) *Attorney, Agent, or Firm* — Eugenio J. Torres-Oyola; Victor M. Rodriguez-Reyes; Rafael Rodriguez-Muriel

(57) ABSTRACT

A cap configured to permit different logos to be interchangeably positioned on the cap. The cap includes a front panel, a back panel and a visor. Further the cap comprises an adjustable strap. The front panel is made out of plastic material with hooks and other panels, such as the back panel and the visor, can also be made out of other materials. The logos are equipped with pile material permits them to be detachably mounted on the cap. A piece of stiffening material is positioned inside of the front panels forming the front face of the cap to maintain the front face in a shape.

7 Claims, 7 Drawing Sheets

(56) References Cited

U.S. PATENT DOCUMENTS 5,996,125 A * 12/1999 Garzone ..... A42B 3/227 2/10
6,175,963 B1 * 1/2001 Loeffelholz ..... A41D 27/08 2/200.1
6,519,779 B1 * 2/2003 Taguchi ..... A42B 1/248 2/195.1
6,643,847 B1 * 11/2003 Dornak ..... A42B 1/062 2/195.1
7,765,618 B2 * 8/2010 Egglesfield ..... A41D 1/04 2/244
D647,286 S * 10/2011 Malek ..... D2/866
9,603,402 B2 * 3/2017 Warner ..... A63F 13/00
9,669,292 B1 * 6/2017 Warner ..... A63F 13/00
2007/0143906 A1 * 6/2007 Renteria ..... A42B 1/064 2/195.1
2009/0255035 A1 * 10/2009 Little ..... A42B 1/22 2/183
2010/0019451 A1 * 1/2010 Kucharski ..... A63F 3/00 273/243
2010/0313334 A1 * 12/2010 Moy ..... A42B 1/248 2/209.13
2011/0041238 A1 * 2/2011 Brzoska ..... A42B 1/205 2/209.13
2011/0067168 A1 * 3/2011 Steiner ..... A42B 1/062 2/209.13
2011/0271418 A1 * 11/2011 Crockett-Grabus ..... A43B 1/0081 2/69
2012/0000005 A1 * 1/2012 Kishihara ..... A41D 19/0096 2/168
2012/0005809 A1 * 1/2012 Johnson ..... A42B 1/248 2/209.13
2012/0180193 A1 * 7/2012 Curiel ..... A42B 1/201 2/209.11
2015/0327614 A1 * 11/2015 Garden, Sr. ..... A42B 1/004 2/209.12
2017/0303618 A1 * 10/2017 Johnson ..... A42B 1/248
2018/0042325 A1 * 2/2018 Regan ..... A41D 27/08
2018/0049500 A1 * 2/2018 Richardson ..... A42B 1/248
2019/0274385 A1 * 9/2019 Fuller ..... A42B 1/22

* cited by examiner

CAP WITH INTERCHANGEABLE ART

CROSS-REFERENCE TO RELATED APPLICATION

N/A

STATEMENT REGARDING FEDERALLY SPONSORED RESEARCH AND DEVELOPMENT

N/A

BACKGROUND OF THE INVENTION

Field of the Invention

The present invention relates to hats and is specifically concerned with hats that can be adorned with different art, such as patches bearing designs, which are detachable and interchangeable.

Discussion of the Background

Most caps are configured to include some kind of fixed logo or design on the front face of the cap which typically includes symbols, slogans or decorative designs. Including these kinds of logos are particularly popular as they allow the wearer to express their allegiance to sporting teams, promote an event and/or companies and also to express their individual tastes in apparel. However, having a permanent indicia or logo sewn or printed onto the fabric of the cap limits the cap to displaying only one logo.

Other caps use hook on attachment elements and pile fastening material "VELCRO" material on the cap surroundings. Unfortunately, repeatedly changing logos on the caps which use hook and pile fastening material, can result in the pile material pulling away from the stiffening material and thereby spoiling the preferred appearance of the front face of the ball cap. This problem is often exacerbated as logos which are attached to the front face of a cap with these types of fasteners can be very difficult to remove and, consequently, much force is exerted on the pile material which can result in the pile material stretching or even ripping after repeated removal of the logos.

It is therefore an object of the present invention to provide a cap which is capable of having different interchangeable logos, and the like, positioned thereon without repeated interchanging of logos altering the appearance of the cap.

SUMMARY OF THE INVENTION

In light of the above shortcomings of the methods available to provide interchangeable logos to a cap, the present invention discloses a cap which is capable of having different interchangeable logos and the like positioned thereon without repeated interchanging of logos altering the appearance of the cap, back panels configured to cover the users' head in combination with the front panel and a visor or peak.

In accordance with the principles of the present invention the cap includes a front panel comprising plastic molded hooks; a stiffening material sewn to an inner portion of the front panel; and an attachable element comprising a pile material attached to it.

Another object of the present invention is to provide an adjustable strap with plastic molded hooks similar to those on the front panel, wherein said adjustable strap is configured to receive an interchangeable band. The adjustable strap with plastic molded hooks assists with an easy assemble and disassemble of an interchangeable band, wherein said attachable band comprises a pile material.

To enable a better understanding of the objectives and features of the present invention, a brief description of the drawing below will be followed with a detailed description of the invention.

DETAILED DESCRIPTION OF THE INVENTION

The present invention discloses several preferred embodiments wherein the front panel and the adjustable strap are preferably made of a non-water absorbent material, such as plastic. The material selection depends on where the cap is operated, employed or used. For example, the material used includes, but is not limited to, heat resistant plastic, odor resistant material and UV repellant material.

Figure 1:
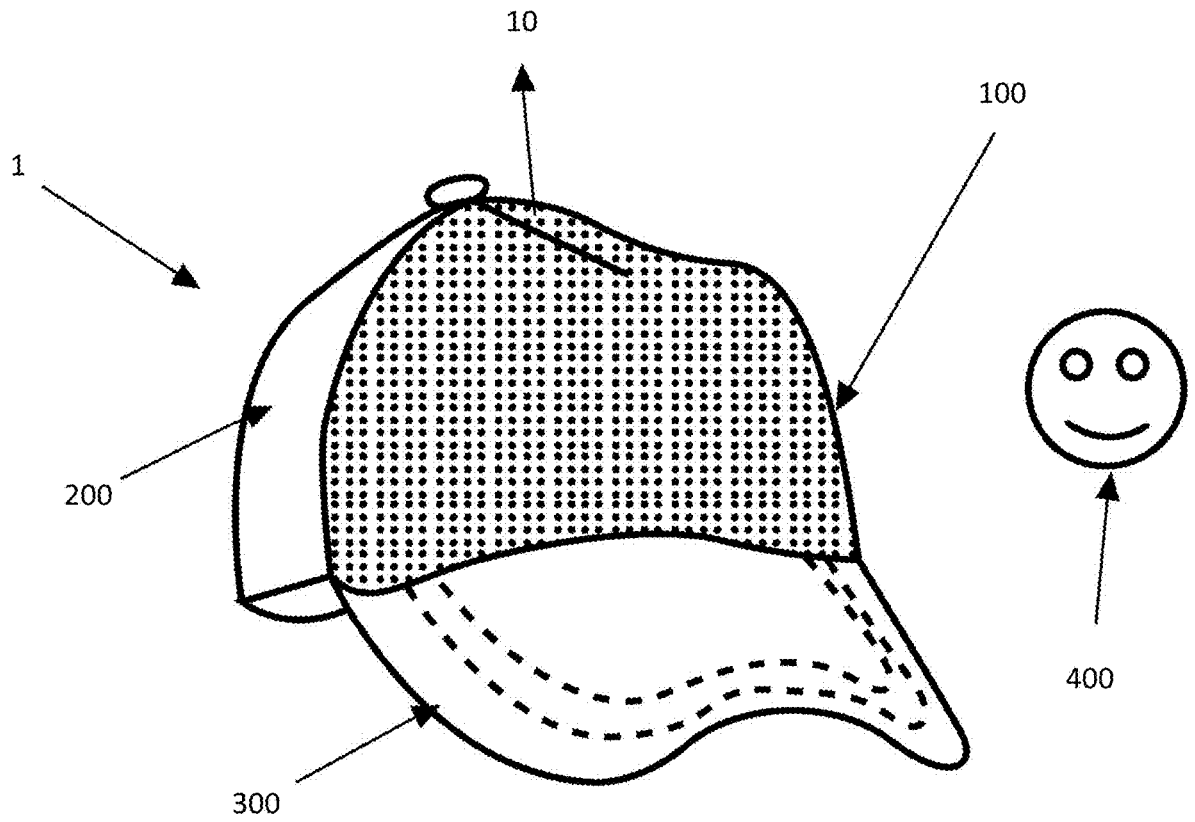
FIG. 1 shows the first exemplary embodiment and the attachable element in accordance with the principles of the present disclosure.
Figure 2:
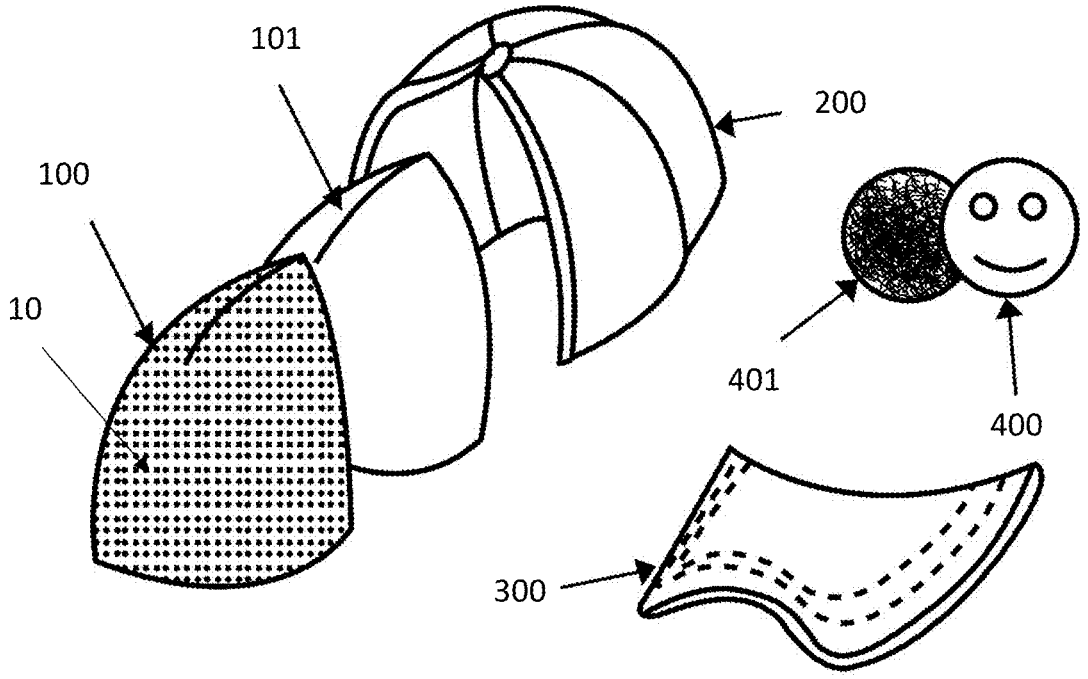
FIG. 2 is an exploded view of the structure of the first exemplary embodiment in accordance with the principles of the present disclosure.

The first exemplary embodiment of the cap 1, as shown in FIGS. 1-2, is described and constructed as follows:

Referring to FIGS. 1 and 2, the cap 1 comprises at least one front panel 100 that is capable of having one or more interchangeable items 400 attached or positioned thereon without having to sew or perform a complicated process to alter the appearance of the cap 1 to attach a new logo. The cap 1 also includes at least one back panel 200 configured to cover a user's head in combination with the front panel 100. The front and back panels 100, 200 are sewn or fastened to each other. It should be noted that each panel includes an inner portion and an outer portion. The outer portion of front panel 100 comprises plastic molded hooks 10; whereas the inner portion comprises a stiffening material 101 or stiff panel that provides support to the front panel. The stiffening material 101 may be any material that allows the cap 1 to spring back into shape after bending or compression, such as a stiff cloth, buckram, etc. The stiffening material 101 may also be attached, fastened or sewn to the back panel 200. Furthermore, the front panel 100 is also attached, fastened or sewn to a visor or peak 300. The interchangeable items 400 can have any shape or be used to display any logo or design.

Figure 6:
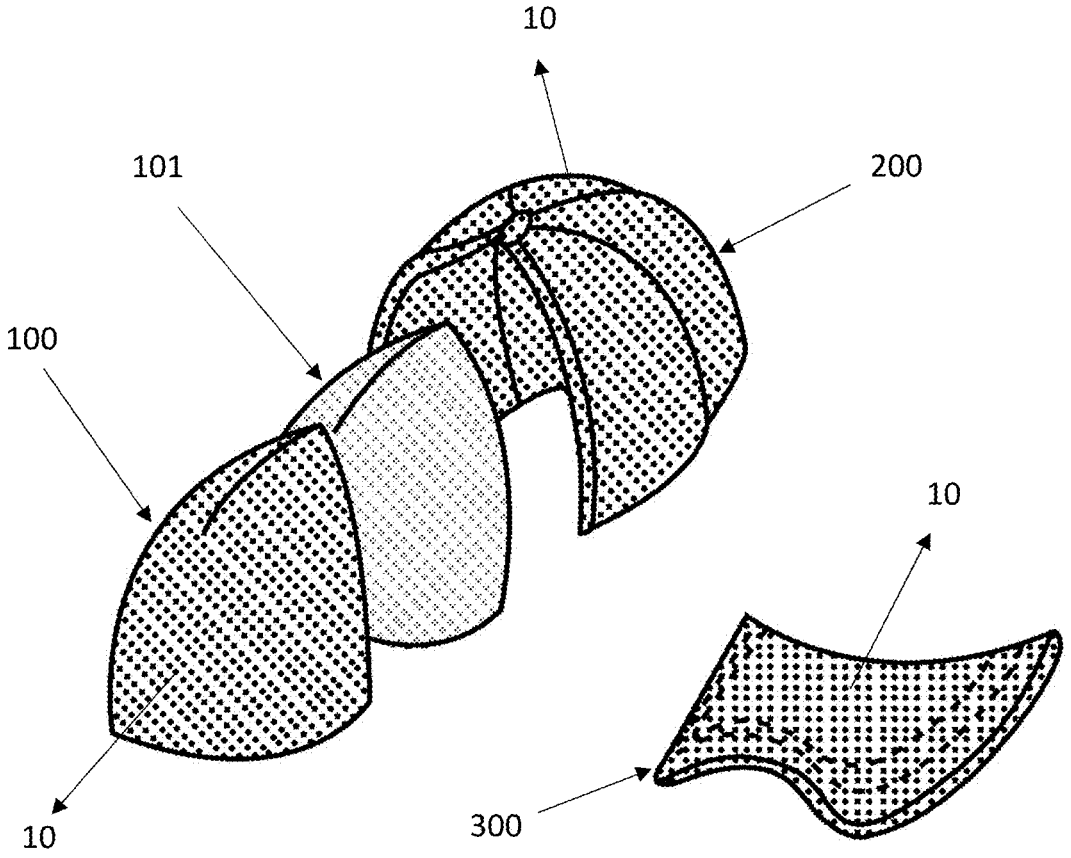
FIG. 6 shows an exploded view of an embodiment in which the front panel, back panel and visor comprise the same material, in accordance with the principles of the present disclosure.

Lastly, it should be noted that the back panel 200 and visor 300 can be made of the same material, as shown in FIG. 6, or a different material as the front panel, as shown in FIGS. 1 and 2.

Figure 7:
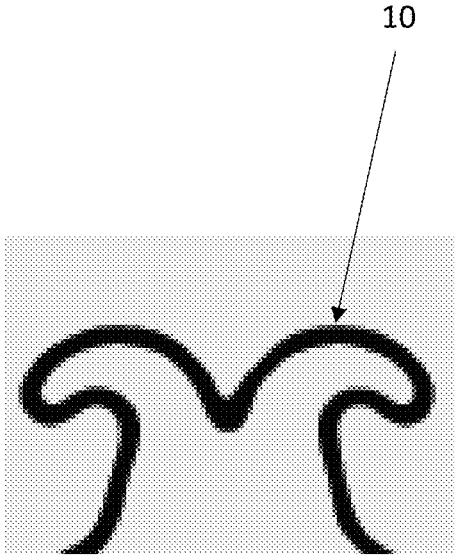
FIG. 7 shows an expanded view of the plastic molded hooks in accordance with the principles of the present disclosure.

The plastic molded hooks 10, as shown in FIG. 7, and attachable element 401 are commercially available and marketed as VELCRO® Brand High Technology Hooks and incorporates a hook and loop fastener system. It is important to note that the cap 1 requires the hooks to be located on the front panel for both functional and ornamental reasons. For example, due to the properties and configuration of the hook and loop fastener system, the portion including the hook provides a clean and more stable appearance when compared to the portion including the loops or pile material. In this manner the front panel 100 will not look deteriorated due to the repeated application of interchangeable items 400. Notwithstanding the foregoing, the present invention also contemplates a cap 1 in which the front panel 100 comprises an attachable element 401—such as a loop or pile material—and the second side of the interchangeable item 400 comprises plastic molded hooks 10.

Figure 3:
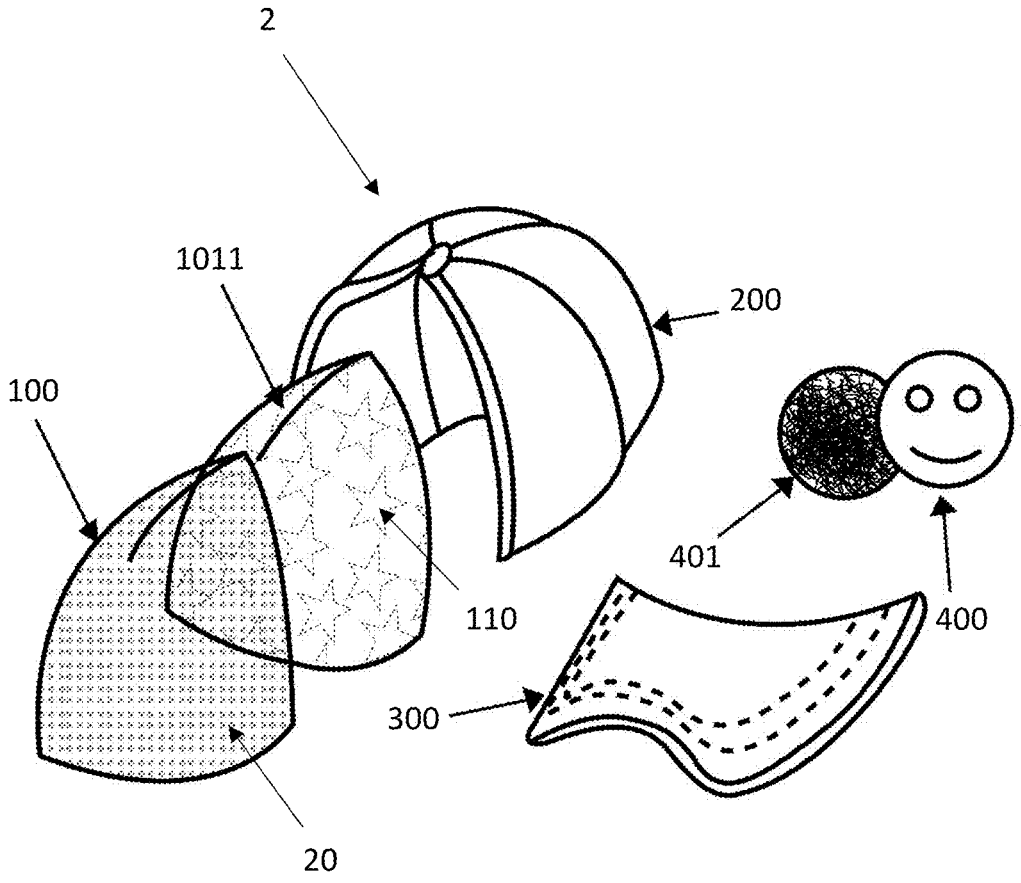
FIG. 3 shows the second exemplary embodiment and the attachable element in accordance with the principle of the present disclosure.
Figure 4:
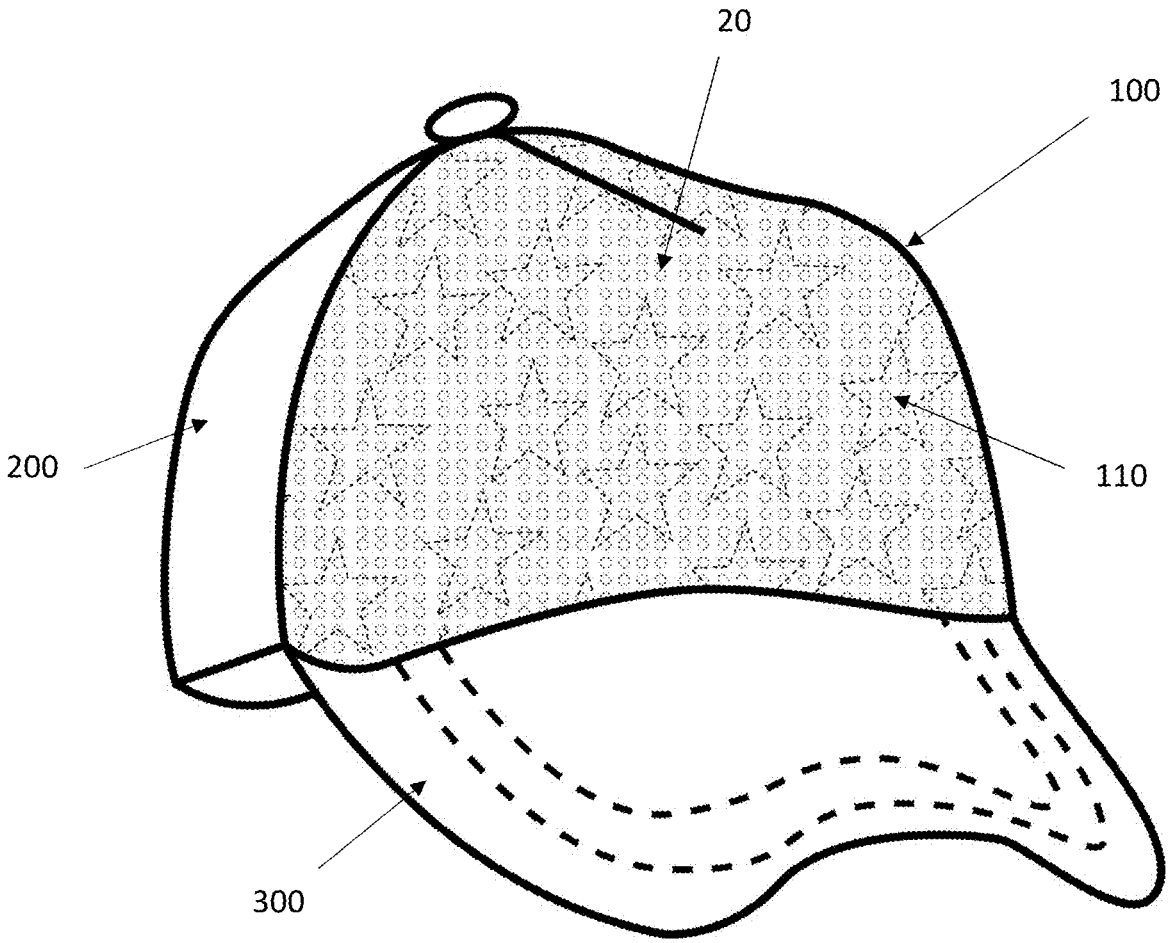
FIG. 4 is an exploded view of the structure of the second exemplary embodiment in accordance with the principles of the present disclosure.

The second exemplary embodiment of cap 2, as shown in FIGS. 3-4, is described and constructed as follows:

Referring to FIG. 3 and FIG. 4 the cap 2 comprises a front panel 100, as describe for the first exemplary embodiment, that is capable of having one or more interchangeable items 400 attached or positioned thereon without having to sew or perform a complicated process to alter the appearance of the cap to attach a new logo.

The cap 2 for the second exemplary embodiment comprises a translucent and/or transparent front panel 100 made of plastic molded hooks 20; a marked stiffening material 1011 or stiff panel on an inner portion of the front panel 100; and a back panel 200. The marked stiffening material 1011 comprises printed indicia 110. The front and back panels 100, 200 are sewn or fastened to each other. It should be noted that each panel includes an inner portion and an outer portion. The outer portion of front panel 100 comprises translucent and/or transparent plastic molded hooks 20; whereas the inner portion comprises a marked stiffening material 1011 that provides support and ornamentation to the front panel. In other words, the translucent and/or transparent front panel 100 is located in front of the marked stiffing material 1011; thus, allowing the printed indicia 110 on the marked stiffing material 1011 to be visible through the front panel 100. The marked stiffening material 1011 may be any material that allows the cap 2 to spring back into shape after bending or compression, such as a stiff cloth, buckram, etc. The stiffening material 1011 may also be attached fastened or sewn to the back panel 200. Furthermore, the front panel 100 is also attached, fastened or sewn to a visor or peak 300.

The translucent and/or transparent plastic molded hooks 20 and attachable element 401 are also commercially available and marketed as VELCRO® Brand High Technology Hooks and incorporates a hook and loop fastener system. It is important to note that the cap 2 requires the hooks to be located on the front panel for both functional and ornamental reasons. For example, due to the properties and configuration of the hook and loop fastener system, the portion including the hook provides a clean and more stable appearance when compared to the portion including the loops or pile material. In this manner the front panel 100 will not look deteriorated due to the repeated application of interchangeable items 400. Notwithstanding the foregoing, the present invention also contemplates a cap 2 in which the front panel 100 comprises an attachable element 401—such as a loop or pile material—and the second side of the interchangeable item 400 comprises plastic molded hooks 20.

Attached to the front panel 100 is the visor or peak 300. The interchangeable items 400 can have any shape or be used to display any logo or design. The interchangeable items 400 preferably includes two sides; on the first side the interchangeable item 400 includes a logo or design, whereas the second side includes an attachable element 401 such as a loop or pile material.

Figure 5:
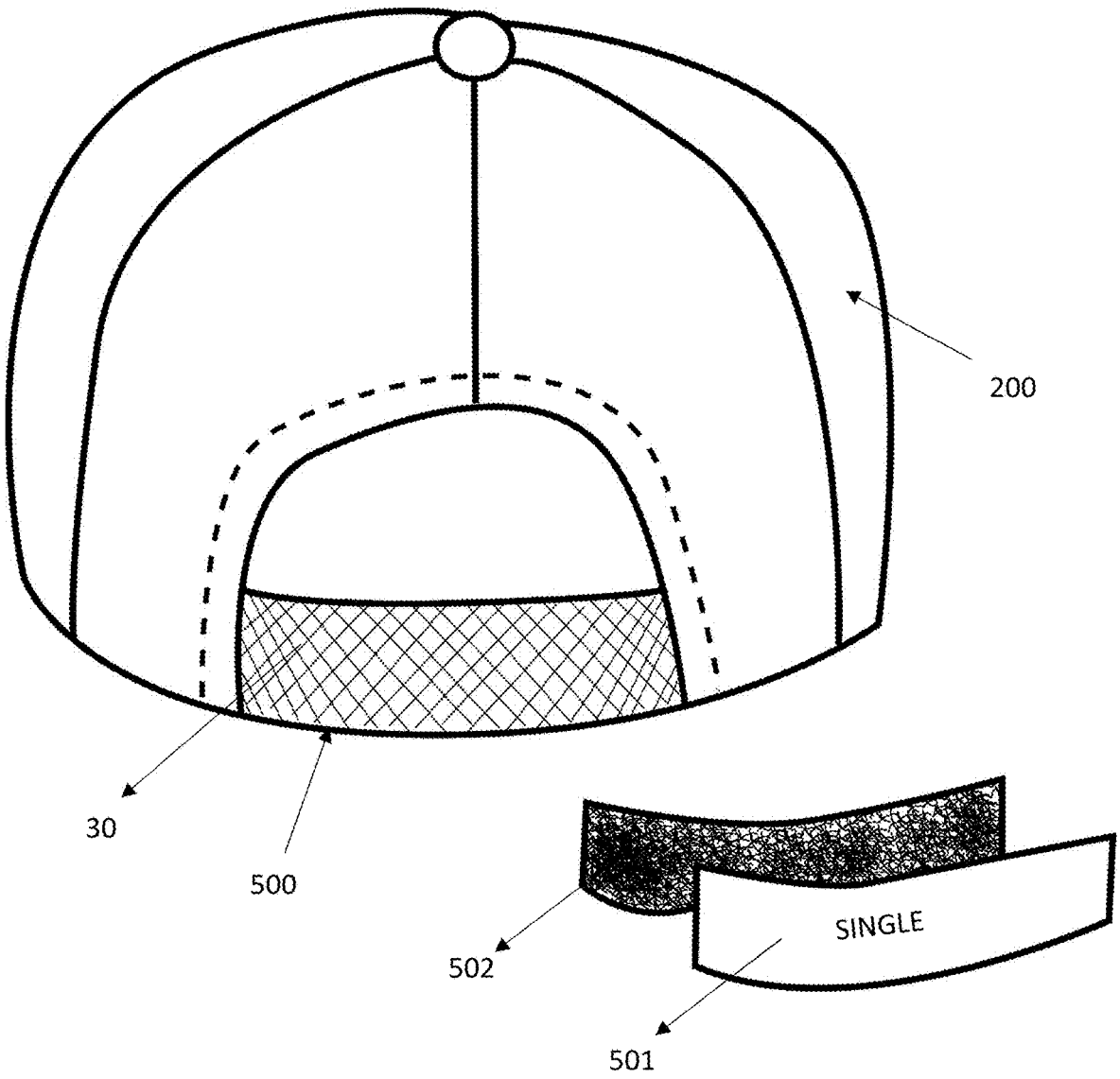
FIG. 5 is an exploded view of the structure of the adjustable strap of the first preferred embodiment of the present invention in accordance with the principles of the present disclosure.

Referring to FIG. 5, an adjustable strap 500 is provided to adjust the size of the cap. The adjustable strap 500 comprises plastic molded hooks 30 and an attachable band 501 that may have any shape or be used to display any logo or design. Further, the attachable band 501 comprises a pile material 502 allows the attachable band 501 to be attached to the adjustable strap 500.

In summary of the previous sections, the invention presented here is structurally innovative, presents advantages not available at the moment with existing caps and is hereby lawfully submitted to the patent bureau for review and the granting of the commensurate patent rights.

While the invention has been described as having a preferred design, it is understood that many changes, modifications, variations and other uses and applications of the subject invention will, however, become apparent to those skilled in the art without materially departing from the novel teachings and advantages of this invention after considering this specification together with the accompanying drawings. Accordingly, all such changes, modifications, variations and other uses and applications which do not depart from the spirit and scope of the invention are deemed to be covered by this invention as defined in the following claims and their legal equivalents. In the claims, means-plus-function clauses, if any, are intended to cover the structures described herein as performing the recited function and not only structural equivalents but also equivalent structures.

All of the patents, patent applications, and publications recited herein, and in the Declaration attached hereto, if any, are hereby incorporated by reference as if set forth in their entirety herein. All, or substantially all, the components disclosed in such patents may be used in the embodiments of the present invention, as well as equivalents thereof. The details in the patents, patent applications, and publications incorporated by reference herein may be considered to be incorporable at applicant's option, into the claims during prosecution as further limitations in the claims to patentable distinguish any amended claims from any applied prior art.

What is claimed is:

1. A cap, comprising:

one or more interchangeable items;

at least one translucent front panel that is capable of having the one or more interchangeable items attached or positioned thereon without having to sew or perform a complicated process to alter the appearance of the cap;

at least one back panel configured to cover a user's head in combination with the translucent front panel;

a visor;

wherein the translucent front panel and the back panel are sewn or fastened to each other;

wherein both the translucent front panel and the back panel include an inner portion and an outer portion;

wherein the outer portion of front panel comprises translucent plastic hooks;

wherein the inner portion includes a stiff panel that provides support to the translucent front panel;

wherein the interchangeable item includes at least two sides;

wherein the first side of the interchangeable item includes a logo or design; and wherein the second side of the interchangeable item includes a pile material configured to be attached to the translucent plastic hooks on the outer portion of front panel.

2. The cap of claim 1, wherein the stiff panel comprises a printed indicia that provides ornamentation to the cap.

3. The cap of claim 1, wherein the stiff panel comprises a material selected from the group consisting of stiff cloth or buckram.

4. The cap of claim 1, wherein the material of the back panel and the visor is different from the material of the translucent front panel.

5. The cap of claim 1, further comprising an adjustable strap in the back panel to adjust the size of the cap.

6. The cap of claim 5, wherein adjustable strap comprises plastic hooks and an attachable band.

7. The cap of claim 6, wherein the attachable band comprises a pile material that allows the attachable band to be attached to the adjustable strap.

* * * * *